United States Patent [19]

Deutschle et al.

[11] 4,358,066

[45] Nov. 9, 1982

[54] APPARATUS FOR SUPPORTING PAPER REELS IN WINDING MACHINES

[75] Inventors: Robert Deutschle, Bokholt-Hanredder; Wolfram Wolf, Bilsen, both of Fed. Rep. of Germany

[73] Assignee: E. C. H. Will (GmbH & Co.), Hamburg, Fed. Rep. of Germany

[21] Appl. No.: 239,171

[22] Filed: Feb. 27, 1981

[30] Foreign Application Priority Data

Feb. 29, 1980 [DE] Fed. Rep. of Germany ..... 3007666

[51] Int. Cl.[3] ..... B65H 17/02

[52] U.S. Cl. ..... 242/68.4; 116/67 A

[58] Field of Search ..... 242/68.4, 68.3, 68, 242/58.6; 116/67 A; 403/27

[56] References Cited

U.S. PATENT DOCUMENTS

| | | | |
|---|---|---|---|
| 3,246,858 | 4/1966 | Alexeff | 242/68.4 |
| 3,645,464 | 2/1972 | Herger | 242/68.3 |
| 4,121,783 | 10/1978 | Wolfinger | 242/68.4 |
| 4,211,375 | 7/1980 | Weiss | 242/68.4 |

*Primary Examiner*—Edward J. McCarthy

*Attorney, Agent, or Firm*—Kontler, Grimes & Battersby

[57] ABSTRACT

Apparatus for supporting the core of a reel of convoluted paper in a winding machine has two trunnions which extend into the end portions of the core from opposite ends of the reel and are surrounded by ring-shaped stops which are normally closely adjacent to the respective end faces of the reel therebetween. The trunnions and the respective stops are movable axially toward and away from the core and each trunnion is surrounded by a ring-shaped sensor which is biased against the respective end face of the reel so that the distance between the sensor and the corresponding stop denotes the width of the gap between the respective end face of the reel and the corresponding stop. Each sensor is connected with a discrete ring-shaped cam by several pins which extend through the corresponding stop and each cam is tracked by one arm of a lever another arm of which can actuate a signal generating device when the width of the gap between the stop and the corresponding end face of the two trunnions exceeds a preselected value. The signal generating device can generate a visible and/or audible signal and/or arrest the prime mover which winds the web from or onto the reel between the two stops.

13 Claims, 2 Drawing Figures

APPARATUS FOR SUPPORTING PAPER REELS IN WINDING MACHINES

BACKGROUND OF THE INVENTION

The present invention relates to machines for winding (paying out or collecting) webs of paper or the like from or onto the cores of reels or analogous carriers of convoluted web or strip material, and more particularly to improvements in apparatus which are used in such machines to support the reels during winding. Still more particularly, the invention relates to improvements in reel supporting apparatus of the type wherein the two ends of the axial hole in the reel which is ready to be rotated receive two coaxial trunnions and the end faces of the reel on the trunnions are disposed between two stops which are designed to hold the reel against excessive axial movement.

As a rule, a reel which includes convoluted paper has a cylindrical sleeve-like core consisting of cardboard or the like. The aforementioned trunnions of the apparatus which supports the reel in a winding machine extend into the end portions of the core from opposite axial ends of the reel. The trunnions are often preferred over a shaft which extends all the way through the core because it is simpler to mount a reel-carrying core on or to remove an empty core from a pair of coaxial trunnions which are movable axially toward and away from each other. Each trunnion and the associated stop is movable axially by a motor (e.g., an electric motor) or by a hydraulic or pneumatic drive so that the reel is placed between the two stops while the trunnions are held apart, and the trunnions are thereupon moved toward each other to penetrate into the respective end portions of the core. As a rule, each of the trunnions and the associated stop is movable by a discrete drive, i.e., each unit including a trunnion and the associated stop can be moved relative to the other unit.

During winding, it is often necessary to shift the entire reel axially of the trunnions, i.e., to move both trunnions in the same direction while maintaining the distance between the stops at a given or constant value. In other words, it is desirable to provide means for ensuring that both trunnions move in synchronism in a direction to the right or to the left, depending on the desired direction of axial displacement of the reel in the winding machine. However, and since the aforementioned units have discrete drives, malfunctions are likely to occur, for example, if one of the units remains at a standstill while the other unit moves away from the one unit or when the other unit moves at a speed exceeding the speed of the one unit. This brings about the danger of completely extracting one or both trunnions from the respective end portion or portions of the core with the result that the thus released reel can damage the machine and/or cause injury to the attendants.

OBJECTS AND SUMMARY OF THE INVENTION

An object of the invention is to provide a novel and improved apparatus which can support a reel of paper or the like in a winding machine in such a way that the core of the reel is much less likely to become accidentally disengaged from the trunnions.

Another object of the invention is to provide an apparatus which can apprise the attendants of improper mounting of a reel therein.

A further object of the invention is to provide the apparatus with novel and improved means for ensuring that the distance between the stops and the respective end faces of a reel in the winding machine does not accidentally exceed a maximum permissible value without any remedial measures to correct the situation.

An additional object of the invention is to provide novel and improved means for monitoring the positions of the reel with reference to the stops in an apparatus of the above outlined character.

Another object of the invention is to provide the apparatus with simple, rugged and inexpensive means for reliably monitoring the position of the reel relative to the stops.

An additional object of the invention is to provide the apparatus which can ensure proper positioning of the reel when the reel is held against axial movement as well as when the trunnions are shifted to move the reel axially.

A further object of the invention is to provide an apparatus which can be installed in existing machines for winding of paper webs with minimal alterations of such machines.

Another object of the invention is to provide the apparatus with novel and improved means for adjusting its components so that the apparatus can properly support reels having relatively short, medium long or very long cores.

The invention resides in the provision of an apparatus for supporting a reel which includes convoluted paper or like flexible material and has two end faces and an axial hole extending between the two end faces. The apparatus comprises a trunnion which is arranged to extend into one end of the hole in a reel, a stop (e.g., a single ring or a composite ring consisting of several interconnected rings coaxial with and surrounding the trunnion) adjacent to one end face of the reel into which the trunnion extends (the trunnion and the stop are movable in the axial direction of the trunnion relative to the reel into which the trunnion extends, for example, to allow for extraction of the trunnion from the core of the reel), sensor means arranged to monitor the distance between the one end face of the reel into which the trunnion extends and the stop, signal generating means (e.g., a light source, a source of audible signals, or a switch or the like which can arrest the prime mover of the winding machine embodying the improved apparatus), and an operative connection between the signal generating means and the sensor means. The operative connection includes means (e.g., a bell crank lever and a rotary cam which is coupled to the sensor means and is tracked by one arm of the bell crank lever) for actuating the signal generating means (so that the latter generates a visible, audible and/or otherwise detectable signal or arrests the prime mover) when the distance between the stop and the one end face of the reel on the trunnion exceeds a predetermined value. For example, the other arm of the bell crank lever can be designed to directly engage the signal generating means when the width of the gap between the stop and the reel exceeds a preselected width. The operative connection can further comprise one or more guide pins extending through the stop in parallelism with the axis of the trunnion to rigidly connect the sensor means (e.g., an annular member which is permanently biased away from the stop and toward the adjacent end face of the reel) with the aforementioned cam.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
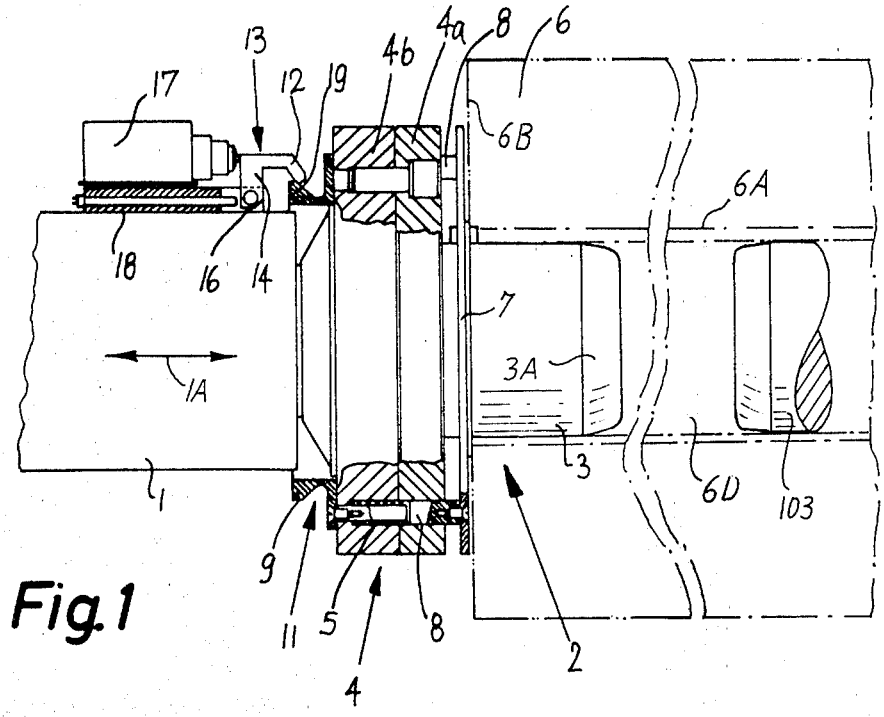
FIG. 1 is a fragmentary partly elevational and partly axial sectional view of one-half of an apparatus which embodies the invention, the sensor means of the illustrated half of the apparatus being held in a position which denotes that the width of the gap between the corresponding stop and the respective end face of a reel of paper or the like is excessive.

The apparatus which is shown in the drawing comprises a support 1 which is installed in the frame (not shown) of a paper winding machine. The support 1 is movable axially of the frame in directions which are indicated by the double-headed arrow 1A. The right-hand end portion of the support 1 carries a rotary unit or head 2 which comprises a trunnion 3 with a rounded frustoconical free end portion 3A and an annular stop 4 consisting of two interconnected rings 4*a*, 4*b* surrounding the trunnion 3 and being rotatable therewith about the axis of the trunnion. The reel 6 (indicated by phantom lines) has a hollow cylindrical sleeve-like core 6A which consists (or which may consist) of cardboard and two end faces one of which is shown at 6B. The purpose of the stop 4 is to serve as an abutment for the end face 6B so as to hold the reel 6 against excessive axial movement in a direction to the left, as viewed in FIG. 1 or 2, when the support 1 is idle (i.e., when the support is not moved in its frame in one of the directions indicated by the arrow 1A).

The exact design of the trunnion 3 forms no part of the invention; this trunnion is preferably designed with a view to transmit torque to the reel 6 when the latter is to rotate and to apply braking torque to the core 6A when the reel is to be arrested. The arrangement is preferably such that the frictional and/or other engagement between the peripheral surface of the trunnion 3 and the internal surface of the respective end portion of the core 6A suffices to abruptly or practically instantaneously arrest the reel 6 (if and when necessary).

In accordance with a feature of the invention, the apparatus which is shown in the drawing further comprises a sensor 7 which is an annular member interposed between the right-hand end face of the stop 4 and the end face 6B of the reel 6 and is movable axially of the trunnion 3 in directions indicated by the arrow 1A. The sensor 7 is biased away from the stop 4, i.e., toward the end face 6B, by one or more helical springs 5 which are installed in the interior of the stop 4 and each of which reacts against an internal shoulder of the part 4. The springs 5 bear against external shoulders on motion transmitting pins 8 which form part of an operative connection between the sensor 7 and a signal generating device 17 adjustably mounted on the support 1. The pins 8 are rigidly connected with the sensor 7 and are reciprocable in axially parallel bores of the stop 4. The left-hand end portions of the pins 8 are rigid with a ring-shaped cam 9 having a circumferential groove 11 for the right-hand arm 12 of a bell crank lever 13. The other arm 14 of the bell crank lever 13 is pivotable on a pin or shaft 16 which is carried by the support 1, preferably on a rail 18 which supports the signal generating device 17. The arrangement is preferably such that the bell crank lever 13 and the signal generating device 17 can be moved in unison toward or away from the cam 9, i.e., toward and away from the stop 4. The left-hand portion of the annular groove 11 in the periphery of the cam 9 is bounded by a steep outwardly and rearwardly sloping surface 19 which can engage the follower arm 12 of the bell crank lever 13 when the cam 9 moves in a direction to the right, as viewed in the drawing, whereby the arm 14 of the lever 13 depresses a contact 17*a* or an analogous element of the device 17 so that the latter generates a visible, audible and/or otherwise detectable signal. The axis of the pin 16 is normal to the axis of the trunnion 3. The rail 18 can be moved with the parts 13 and 17 in parallelism with the axis of the trunnion 3 and can be fixed in any one of a number of different positions best suited to ensure adequate engagement between the surface 19 and the follower arm 12 when the width of the clearance or gap between the right-hand end face of the stop 4 and the left-hand end face 6B of the reel 6 increases beyond a permissible maximum value.

Figure 2:
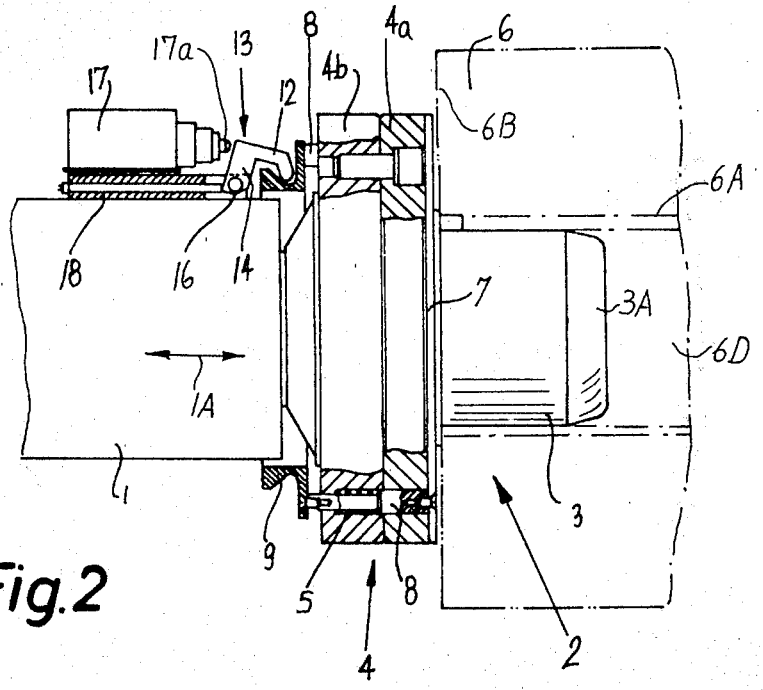
FIG. 2 illustrates the structure of FIG. 1 but with the left-hand end face of the reel located at a requisite distance from the stop.

The drawing merely shows one half of the supporting apparatus. The other half of the apparatus is mirror symmetrical to the structure which is shown in FIG. 1 or 2, and its components are movable in the aforementioned frame axially of the trunnion 3 but independently thereof. FIG. 1 shows a portion of a second trunnion 103 which forms part of the other half of the apparatus and extends into the right-hand end portion of the axial hole 6D in the core 6A of the reel 6.

The operation of the improved apparatus is as follows:

When the reel 6 is in the process of being installed in the supporting apparatus, the trunnions 3 and 103 are held apart to allow for placing of the core 6A into accurate alignment with such trunnions. The trunnions 3 and 103 are thereupon moved toward each other (or at least one of the trunnions is moved toward the other trunnion) so that the trunnions penetrate into the respective end portions of the hold 6D. FIG. 1 illustrates a condition when the distance between the end face 6B of the reel 6 and the right-hand end face of the stop 4 is still excessive, i.e., when the springs 5 are free to maintain the sensor 7 in an axial position in which the sensor 7 causes the cam 9 (via guide pins 8) to maintain the bell crank lever 13 in an angular position such that the arm 14 depresses the contact 17*a* of the signal generating device 17, i.e., the latter transmits a signal denoting that the mounting of the reel 6 is unsatisfactory. If desired, the signal generating device 17 can be designed to arrest the prime mover which effects withdrawal of a paper web from the reel 6 or which effects winding of the web onto the core 6A as long as the distance between the reel 6 and the stop 4 is excessive. It will be noted that, in FIG. 1, the cam 9 is immediately adjacent to the left-hand end face of the stop 4 and, therefore, the follower arm 12 of the bell crank lever 13 causes the other arm 14 to assume an angular position in which the device 17 generates a signal. The arm 12 then engages the surface 19 in the groove 11 of the cam 9.

As the support 1 continues to move in a direction to the right (and/or the reel 6 continues to move in a direction to the left, as viewed in FIG. 1), the end face 6B of the reel 6 moves the sensor 7 axially and toward the right-hand end face of the stop 4. This causes the cam 9 to move away from the left-hand end face of the stop 4 at a rate which is proportional to the rate of reduction of the width of the gap between the end face 6B and the stop 4. The bell crank lever 13 pivots under the action of gravity or under the action of a spring (not shown) so that it penetrates into the deeper or deepmost portion of the groove 11 and the arm 14 is disengaged from the contact 17*a*, i.e., the device 17 ceases to transmit a signal. The spring or springs 5 then store energy and maintain the sensor 7 in contact with the end face 6B of the reel 6 which rotates with the unit including the trunnion 3 and the stop 4. The trunnion 103 also rotates with the reel 6.

The configuration of the surface bounding the groove 11 of the cam 9 is preferably such that, when the width of the gap between the end face 6B and the stop 4 is not excessive, the follower arm 12 of the bell crank lever 13 hardly contacts the cam 9 or is totally out of contact with the cam. This is desirable because the bell crank lever 13 does not rotate with the reel 6 whereas the angular movements of the reel are shared by the sensor 7 as well as by that portion of the operative connection between the sensor and the signal generating device 17 which includes the guide pins 8, the springs 5 and the cam 9. Accurate positioning of the bell crank lever 13 relative to the cam 9 so as to ensure that the arm 12 is out of contact with the surface 19 when the distance between the reel 6 and the stop 4 is satisfactory can be readily achieved by properly adjusting the rail 18 with respect to the support 1, i.e., by shifting the rail in parallelism with the axis of the trunnion 3.

If the attendants decide to move the reel 6 axially while the core 6A collects or pays out a paper web or the like, the two units are moved in a direction to the right or to the left, as viewed in the drawing, so as to ensure that the distance between the two end faces of the reel and the respective stops remains unchanged or remains within acceptable limits. If such distance is exceeded at the one and/or the other axial end of the reel 6, the respective device 17 generates a signal which warns the attendants and/or automatically stops the prime mover which drives the trunnions. This is due to the fact that the respective set of springs 5 then urges the corresponding sensor 7 away from the adjacent stop 4 and the cam 9 causes the bell crank lever 13 to actuate the device 17. The device 17 generates a signal when the two units fall to move in synchronism regardless of whether one of the units does not move at all or whether the leading unit moves at a speed exceeding the speed of the trailing unit.

An important advantage of the improved supporting apparatus is that it is surprisingly simple, compact and inexpensive. The operative connection between the signal generating device 17 and the respective sensor 7 (which is or can be a simple metallic or plastic ring) is rudimentary and, therefore, it can stand long periods of use. The purely mechanical connection between the signal generating device 17 and the sensor 7 has been found to be particularly advantageous and desirable because it operates properly even after extensive use and attendant pronounced wear upon its parts. The sensor 7 can be used to effect the generation of signals during installation of a fresh reel in the winding machine as well as when the machine is in actual use.

It is clear that, at least in certain instances, it suffices to provide a sensor, a signal generating device and an operative connection between such device and the sensor only at one axial end of the reel. This contributes to further simplification of the improved apparatus. It is also clear that the illustrated annular member 7 constitutes but one form of sensor means which can be used in the improved apparatus. The same holds true for the signal generating device 17 and for the operative connection between the device 17 and the sensor 7. For example, the operative connection can comprise one or more proximity switches which actuate or activate the signal generating device 17 when the sensor 7 moves away from the stop 4 to such an extent that the width of the gap between the reel and the stop warrants the generation of a signal. However, the aforedescribed mechanical operative connection has been found to be quite satisfactory and is preferred at this time because it can stand long periods of use and abuse with a minimum of wear and a minimum of maintenance work.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supporting a reel which includes convoluted paper or like flexible material and has two end faces and an axial hole extending between such end faces, comprising a trunnion arranged to extend into one end of the hole in a reel; a stop adjacent to one end face of the reel whose hole receives said trunnion, said stop and said trunnion being movable in the axial direction of the trunnion and of the reel into which said trunnion extends; sensor means arranged to monitor the distance between the one end face of the reel into which said trunnion extends and said stop; signal generating means; and an operative connection between said signal generating means and said sensor means, including means for actuating said signal generating means when said distance exceeds a predetermined value.

2. The apparatus of claim 1, wherein said stop surrounds said trunnion and said sensor means comprises an annular member surrounding said trunnion and being axially movable with respect thereto intermediate said stop and the one end face of the reel into which said trunnion extends, said operative connection further including means for biasing said annular member axially of said trunnion and away from said stop.

3. The apparatus of claim 2, wherein said actuating means comprises a device which shares the movements of said annular member with reference to said trunnion.

4. The apparatus of claim 3, wherein said device includes a cam, said stop being disposed between said cam and said annular member and said operative connection further comprising at least one guide member parallel to the axis of said trunnion and connecting said cam with said annular member, said guide member being reciprocable in said stop.

5. The apparatus of claim 4, wherein said biasing means includes resilient means reacting against said stop and bearing against said guide member in a direction to move said annular member away from said stop.

6. The apparatus of claim 5, wherein said actuating means further comprises lever means pivotable by said cam and arranged to actuate said signal generating means in response to movement of said cam in a direction toward said stop as a result of movement of said annular member away from said stop.

7. The apparatus of claim 6, wherein said cam is a ring-shaped cam having a peripheral cam face and said lever means includes a lever pivotable about a predetermined axis and having a first arm tracking said cam and a second arm arranged to actuate said signal generating means.

8. The apparatus of claim 7, wherein said lever is a bell crank lever.

9. The apparatus of claim 8, further comprising a support for said trunnion and said stop, said operative connection further comprising a pivot member for said lever, said pivot member being carried by said support.

10. The apparatus of claim 7, wherein said peripheral cam face has a circumferential groove and said first cam extends into said groove.

11. The apparatus of claim 6, further comprising a support for said lever means and said signal generating means, said signal generating means and said lever means being movable relative to said support in parallelism with the axis of said trunnion.

12. The apparatus of claim 1, wherein said stop includes a plurality of coaxial rings surrounding said trunnion.

13. The apparatus of claim 1, wherein said stop includes at least one ring coaxial with and surrounding said trunnion and said sensor includes an annular member interposed between said ring and the one end face of the reel into which said trunnion extends.

* * * * *